US006113661A

United States Patent [19]

Germanaud et al.

[11] Patent Number: 6,113,661

[45] Date of Patent: Sep. 5, 2000

[54] FUEL COMPOSITION FOR DIESEL ENGINES CONTAINING OXYGENATED COMPOUNDS

[75] Inventors: Laurent Germanaud, Valencin; Paul Maldonado, Saint Symphorien d'Ozon; Paul Bourdauducq, Chaponost; Jean-Luc Couturier, Lyons, all of France

[73] Assignee: Elf Antar France, Courbevoie, France

[21] Appl. No.: 09/147,658

[22] PCT Filed: Jun. 8, 1998

[86] PCT No.: PCT/FR98/01168

§ 371 Date: May 4, 1999

§ 102(e) Date: May 4, 1999

[87] PCT Pub. No.: WO98/56879

PCT Pub. Date: Dec. 17, 1998

[30] Foreign Application Priority Data

Jun. 9, 1997 [FR] France ..... 97 07119

[51] Int. Cl.[7] ..... C10L 1/18

[52] U.S. Cl. ..... 44/444; 44/349; 44/350

[58] Field of Search ..... 44/444

[56] References Cited

U.S. PATENT DOCUMENTS

| | | | |
|---|---|---|---|
| 2,842,432 | 7/1958 | Newman et al. | 44/444 |
| 2,897,068 | 7/1959 | Pellegrini et al. | 44/444 |
| 4,395,267 | 7/1983 | Sweeney | 44/444 |
| 5,268,008 | 12/1993 | Kanne | 44/444 |
| 5,308,365 | 5/1994 | Kesling, Jr. et al. | 44/444 |
| 5,746,785 | 5/1998 | Moulton et al. | 44/443 |

FOREIGN PATENT DOCUMENTS

| | | |
|---|---|---|
| 0 014 992 | 9/1980 | European Pat. Off. . |
| 0 030 429 | 6/1981 | European Pat. Off. . |
| 0 102 544 | 3/1984 | European Pat. Off. . |
| 0 568 336 | 11/1993 | European Pat. Off. . |
| 0 639 404 | 2/1995 | European Pat. Off. . |
| 868 233 | 9/1941 | France . |
| 2 544 738 | 10/1984 | France . |
| 29 11 411 | 9/1980 | Germany . |
| WO 86/03511 | 6/1986 | WIPO . |
| WO 98/56879 | 12/1998 | WIPO . |

OTHER PUBLICATIONS

PCT Search Report, PC/FR98/01168, Elf Antar France et al., Aug. 1998.

*Primary Examiner*—Ellen M. McAvoy

*Attorney, Agent, or Firm*—Oblon, Spivak, McClelland, Maier & Neustadt, P.C.

[57] ABSTRACT

A fuel composition containing, as a major portion, at least one fuel base, and, as a minor portion, at least one oxygenated compound, which contains at least 0.05% by weight of at least one trialkoxyalkane of the formula (I):

(I)

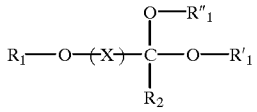

wherein:

X is a divalent hydrocarbon-containing group $C_nH_{2n}$, wherein n is 1, 2, or 3, each hydrogen atom optionally being substituted by a hydrocarbon-containing residue;

$R_1$, $R'_1$, and $R''_1$ are each independently linear or branched alkyl groups containing from 1 to 10 carbon atoms and optionally at least one oxygen atom, two of each of $R_1$, $R'_1$ and $R''_1$ groups optionally being connected to form a heterocyclic ring containing 5 or 6 atoms; and $R_2$ is a hydrogen atom or a linear $C_1$–$C_4$ alkyl radical, or $R_2$ and hydrocarbon-containing residue X, together by bonding, form a ring containing 5 or 6 carbon atoms.

16 Claims, No Drawings

FUEL COMPOSITION FOR DIESEL ENGINES CONTAINING OXYGENATED COMPOUNDS

FIELD OF THE INVENTION

Description of the Background

The present invention relates to a novel fuel composition comprising oxygenated compounds improving the combustion of the fuel, in particular compounds which can improve the cetane number of fuel bases, such as middle distillates, used in the composition of gas oils for diesel engines.

It is well known to introduce oxygenated components, such as MTBE, ETBE and others, into fuels in order to improve the octane number, in order in particular to replace the lead which was introduced therein in the past.

The term for a gas oil is not octane number but rather a cetane number corresponding, like the octane number, to a combustion characteristic of the fuel in an internal combustion engine. This cetane number more particularly represents the ability of the fuel base to self-ignite in the combustion chamber of the engine. An excessively low cetane number corresponds to an excessively long self-ignition delay, which results in late, violent and incomplete combustion with the formation of non-combusted residues. This poor combustion is reflected by an increase in the polluting emissions in the exhaust, an increase in the noise corresponding to the self-ignition of the fuel, in particular when the engine is idling, and greater difficulties in starting the engine, in particular when cold, since the combustion is delayed. It is therefore preferable, in order for diesel engines to operate well, to have available a fuel which exhibits a high cetane number. However, this high cetane number depends on the nature of the fuel base used and on the nature and the effectiveness of the so-called procetane or cetane-improving additives which it is necessary to add to these bases.

A fuel base is generally composed of a physical mixture of several petroleum fractions or middle distillates resulting from the refining of crude oils originating from anywhere in the world. These petroleum fractions result from a great number of separations by atmospheric or vacuum distillation and chemical conversions of some of these distilled fractions by hydrodesulphurization and/or catalytic cracking. A great variety of fuel bases with relatively different physicochemical properties is obtained by appropriate mixing of these various refined fractions. Finally, the diesel fuels or gas oils which can be used in internal combustion engines are prepared by a complex mixing of these bases. However, in order to obtain fuels which observe current legal specifications, refiners have to develop increasingly complicated formulations which favour crude oils highly concentrated in distillates and fuel bases with a high cetane number.

The small amount of readily accessible refined fractions having a sufficiently high cetane number has forced refiners to search for additives or components which, mixed with these fractions, are capable of increasing the cetane number.

The use is known among additives, that is to say compounds introduced at low contents into refined fractions, of organic nitrates or peroxides which are known to have a limited effectiveness in fuel bases or gas oils naturally exhibiting a low cetane number. In addition, organic peroxides decompose irreversibly as a function of the time, which results in a deterioration in the characteristics of stored gas oil, both with regard to quality and with regard to cetane number.

Refiners have searched for a long time for other sources of compounds which can make it possible to improve the cetane number of fuel bases and gas oils, in particular among oxygenated compounds, such as ethers, polyethers or acetals. The addition of oxygenated compounds to gas oils makes it possible to reduce emissions of pollutants, in particular emissions of particles (EP 14,992).

Thus, U.S. Pat. No. 5,308,365 claims the addition of 1 to 30% by weight of dialkylated and trialkylated glycerol derivatives, obtained by addition of an olefin, such as isobutene, to glycerol, in a gas oil having a range of use of between 160° C. and 370° C. and a sulphur content of less than or equal to 500 ppm.

U.S. Pat. No. 5,425,790 claims the use of an additive of general formula $H—(OA)_n—H$ where A has an ethylene structure substituted by a methyl or ethyl group and n is an integer of between 10 and 25.

Patent JP 07258661 claims a formulation comprising 20 to 94% of a gas oil fraction having a distillation range of between 130° C. and 400° C., 5 to 40% of a hydrocracked gas oil fraction known as LCO and 1 to 40% of a monoether of formula $R_1OR_2$ in which $R_1$ and $R_2$ are alkyl chains comprising 3 to 12 carbon atoms.

Patent JP 07018271 claims gas oils comprising glycol ethers of formula $R_1—(OA)_n—R_2$ in which $R_1$ is an alkyl chain comprising 1 to 10 carbon atoms, $R_2$ represents a hydrogen atom or an alkyl chain comprising from 1 to 10 carbon atoms, A has an optionally substituted ethylene or trimethylene structure and n is an integer varying from 1 to 10.

Patent JP 06340886 claims the addition to a gas oil of 0.05% to 20% by weight of a compound of general formula $R_1—O—(EO)_n—(PO)_m—R_2$ in which $R_1$ and $R_2$ separately represent a hydrogen atom or an alkyl chain comprising from 1 to 20 carbon atoms, EO and PO respectively representing oxyethylene and oxyisopropylene groups, and m and n are integers of between 0 and 15.

On the other hand, Patent FR 2,544,738 claims acetals of formula $C_4H_9—O—CR_1R_2—O—C_4H_9$ as component of diesel fuels, it being possible for $R_1$ and $R_2$ to be hydrogen or an alkyl group.

However, these compounds of the prior art, in particular low molecular weight acetals or alternatively ethers comprising several oxygen atoms, have a major disadvantage related to their high hydrophilic nature, which promotes the trapping of water in the fuels. Now, it is well-known that water in fuels generates corrosion and wear of the mechanical components and, in addition, that it promotes growth of bacteria in the line which block the filters and the feed systems, which results in poor operation of the engine.

Another disadvantage of these oxygenated compounds, in particular ethers and polyethers, is related to their multistage manufacturing method, which makes them expensive and limits their continuous manufacture on a large scale.

SUMMARY OF THE INVENTION

The present invention is targeted at the use of a novel family of oxygenated compounds in diesel fuels which make it possible to increase the cetane number and to introduce greater flexibility into the formulation of diesel fuels for a lower cost and in addition make it possible to limit the aromatic and sulphur-comprising compounds responsible for the emission of particles.

DETAILED DESCRIPTION OF THE PREFERRED EMBODIMENTS

The subject-matter of the present invention is therefore a fuel composition comprising a major part of at least one fuel base and a minor part of at least one oxygenated compound, characterized in that it comprises at least 0.05% by weight of at least one trialkoxyalkane of general formula (I) below:

(I)

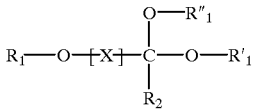

in which:

X corresponds to a divalent hydrocarbon-comprising group $C_nH_{2n}$ in which n is equal to 1, 2 or 3, each hydrogen atom optionally being substituted by a hydrocarbon-comprising residue;

$R_1$, $R'_1$ and $R''_1$ are identical or different, linear or branched, alkyl groups comprising from 1 to 10 carbon atoms and optionally at least one oxygen atom, two of the $R_1$, $R'_1$ and $R''_1$ groups optionally being connected in order to form a heterocycle comprising 5 to 6 atoms;

and $R_2$ being a hydrogen atom or a linear alkyl radical comprising from 1 to 4 carbon atoms, it even being possible for $R_2$ to form, by bonding with a hydrocarbon-comprising residue of X, a ring comprising from 5 to 6 carbon atoms.

In the context of the present invention, this fuel composition contains from 60 to 99.95% by weight of at least one fuel base and from 0.05 to 40% by weight of trialkoxyalcane of formula (I).

Fuel base is understood to mean any petroleum fraction after refining, either by distillation or by treatment of these distilled fractions.

In a first embodiment of the invention, the trialkoxyalkane is chosen from trialkoxypropanes of formula (II) below:

(II)

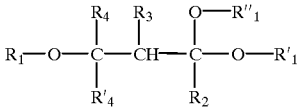

in which:

$R_1$, $R'_1$ and $R''_1$ are identical or different, linear or branched, alkyl groups comprising from 1 to 10 carbon atoms and optionally at least one oxygen atom, two of the $R_1$, $R'_1$ and $R''_1$ groups optionally being connected in order to form a heterocycle comprising 5 to 6 atoms;

$R_2$, $R_3$, $R_4$ and $R'_4$ are identical or different groups representing hydrogen or a linear alkyl radical comprising from 1 to 4 carbon atoms, it even being possible for $R_2$ to form, by bonding with $R_4$ or $R'_4$, a ring comprising from 5 to 6 carbon atoms.

In a first embodiment of the invention, in the formula (II), $R_2$, $R_3$, $R_4$ and $R'_4$ are a hydrogen atom.

In a first alternative form of this first embodiment, $R_1$, $R'_1$ and $R''_1$ are identical and are chosen from alkyl groups comprising from 1 to 4 carbon atoms.

The trialkoxyalkane compounds thus obtained of the invention are chosen from the group consisting of trimethoxypropane, triethoxypropane, tripropoxypropane and tributoxypropane.

In a second alternative form of this first embodiment, $R_1$, $R'_1$ and $R''_1$ comprise from 1 to 4 carbons and at least one oxygen atom.

Among the compounds thus formed, the choice will preferably be made from the group consisting of tri (methoxyethoxy)propane and tri(ethoxyethoxy)propane.

In a third alternative form of this first embodiment, $R_1$ is an alkyl group comprising from 1 to 4 carbon atoms and $R'_1$ and $R''_1$ are connected and constitute a linkage comprising 2 to 3 carbons, so as to form, with the two oxygen atoms, a heterocycle comprising 5 to 6 atoms. Preference is given, among these compounds, to 2-(2-hydroxyethyl)ethoxy-1,3-dioxolane.

In a second embodiment of the invention, in the formula (II), $R_4$ is an alkyl group comprising 1 to 4 carbon atoms, $R_2$, $R_3$ and $R'_4$ are hydrogen atoms and $R_1$, $R'_1$ and $R''_1$ are alkyl groups comprising from 1 to 5 carbon atoms.

Preference is given, among the compounds thus defined, to 1,1,3-trimethoxybutane, 1,1,3-triethoxybutane, 1,1,3-tripropoxybutane and 1,1,3-tributoxybutane.

In a third preferred embodiment of the invention, in the formula (II), $R_2$ (or $R_3$) is an alkyl group comprising 1 to 4 carbon atoms, $R_4$, $R'_4$ and $R_3$ (or $R_2$) are hydrogen atoms and $R_1$, $R'_1$ and $R''_1$ are alkyl groups comprising from 1 to 5 carbon atoms.

Among the preferred compounds of this alternative form, 1,1,3-triethoxy-2-methylpropane and 1,3,3-triethoxybutane are preferred.

In a fourth embodiment of the invention, in the formula (II), $R_3$ and $R_4$ are hydrogen atoms, $R_2$ and $R'_4$ are connected in order to form a saturated ring comprising from 5 to 6 carbon atoms and $R_1$, $R'_1$ and $R''_1$ are alkyl groups comprising from 1 to 5 carbon atoms.

Preference is given, among the compounds constituting this alternative form of the invention, to 1,1,3-triethoxycyclohexane.

In implementing the invention, the fuel bases are chosen from refined fractions distilling between 170 and 370° C. comprising at most 50% by weight of aromatics and less than 0.2% by weight of sulphur-comprising compounds.

The examples below are given by way of illustration but without implied limitation of the invention.

EXAMPLE I

Preparation of 1,1,3-triethoxypropane 1,1,3-Triethoxypropane was synthesized according to a Patent FR 1,447,138 of Jan. 30, 1964. The catalyst used for the reaction is a sulphonic acid resin. The final neutralization, which was not mentioned in this patent, is carried out with a basic resin.

800 g of absolute ethanol (17.4 mol) and 25 g of Amberlyst® 15 resin strongly acidic macroreticular resin, suitable for non-aqueous catalysis (Aldrich), washed beforehand with ethanol and dried, are charged to a 2 l reactor. 185 g of acrolein (3.3 mol) are introduced at 50° C. over a period of 4 hours. At the end of the addition, the mixture is left to react for 3 hours at 50° C. The reaction mixture is filtered, neutralized by stirring for one hour with 8 g of Amberlyst® A21 resin weakly basic, macroreticular resin (Aldrich, washed beforehand with ethanol), and then again filtered. After distillation (B.t.=75–78° C./25 mbar), 390 g of 1,1,3-triethoxypropane are obtained (Yield=67%).

EXAMPLE 2

The cetane number of the 1,1,3-triethoxypropane prepared according to Example 1 was measured according to ASTM Standard D613 by preparing a 20% mixture in two gas oils, the characteristics of which are shown below:

TABLE I

| | Gas oil A | Gas oil B | Method |
|---|---|---|---|
| Distillation range | | | NF M 07-002 |
| - starting point | 176° C. | 201° C. | |
| - 10% vol | 204° C. | 249° C. | |
| - 20% vol | 215° C. | 267° C. | |
| - 50% vol | 253° C. | 290° C. | |
| - 95% vol | 342° C. | 339° C. | |
| % aromatics | 25.7 | 30 | |
| Sulphur content | 0.050% | 0.21% | NFT 60-142 |
| Cetane number measured | 50 | 54 | NFM 07-035 |

The cetane number CN of the pure 1,1,3-triethoxypropane is deduced from the measured value of the cetane number of the mixture, by assuming a linear mixing law, according to the equation:

$$CN(1,1,3\text{-triethoxypropane}) = \frac{CN\ \text{mixture} - 0.8\ CN\ \text{gas oil}}{0.2}$$

TABLE II

| MIXTURE | COMPOSITION | CN MIXTURE | CN 1,1,3-Triethoxy-propane |
|---|---|---|---|
| A | 80% gas oil A<br>20% 1,1,3-triethoxypropane | 55.6 | 78 |
| B | 80% gas oil B<br>20% 1,1,3-triethoxypropane | 59.8 | 83 |

EXAMPLE 3

In this example, the cetane number, the boiling temperature and the solubility in water of 1,1,3-triethoxypropane and those of components already known or cited in the prior art were compared.

A compound having a cetane number of greater than 70, a boiling temperature of at least 160° C. and a very low solubility in water can be regarded as an ideal component which can be used in a gas oil.

TABLE III

| Compound | Boiling temperature (° C.) | Solubility in water (%) | Cetane number |
|---|---|---|---|
| 1,1,3-Triethoxypropane | 180 | <1 | 80 |
| Ethylene glycol ethyl ether | 135 | miscible | 38 |
| Ethylene glycol ethyl, butyl ether | 140 | #4 | 51 |
| Diethylene glycol ethyl ether | 202 | miscible | 54 |
| Diethylene glycol butyl ether | 230 | miscible | 59 |
| Diethylene glycol methyl, butyl ether | 196 | #10 | 55 |
| Diethylene glycol dimethyl ether | 162 | miscible | 61 |
| Diethylene glycol diethyl ether | 177 | miscible | 95 |
| Formaldehyde diethyl acetal | 89 | miscible | 57 |
| Formaldehyde dibutyl acetal | 177 | <5 | 65 |

What is claimed is:

1. A fuel composition, comprising, as a major portion thereof, at least one fuel base and, as a minor portion thereof, at least one oxygenated compound, which comprises at least 0.05% by weight of at least one trialkoxyalkane of the formula (I):

(I)

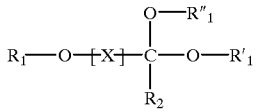

in which:

X is a divalent hydrocarbon-containing group $C_nH_{2n}$, wherein n is 1, 2 or 3, each hydrogen atom optionally being substituted by a hydrocarbon-containing residue;

$R_1$ $R'_1$ and $R''_1$ are each independently linear or branched alkyl groups comprising from 1 to 10 carbon atoms and optionally at least one oxygen atom, two of the $R^1$, $R''_1$ groups optionally being connected to form a heterocycle containing 5 or 6 atoms; and $R_2$ is a hydrogen atom or a linear $C_1$–$C_4$ alkyl radical, or $R_2$ forms, by bonding with the hydrocarbon-containing group X, a ring comprising 5 or 6 carbon atoms.

2. The fuel composition of claim 1, which comprises from 60 to 99.95% by weight of at least one fuel base and from 0.05 to 40% by weight of the trialkoxyalkane of formula (I).

3. The fuel composition of claim 1, wherein the trialkoxyalkane has the formula (II):

(II)

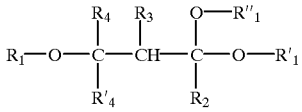

in which $R_1$, $R'_1$, and $R''_1$ are each independently linear or branched alkyl groups comprising from 1 to 10 carbon atoms and optionally at least one oxygen atom, two of the $R_1$, $R'_1$ and $R''_1$ groups optionally being connected in order to form a heterocycle comprising 5 to 6 atoms; and $R_2$, $R_3$, $R_4$ and $R'_4$ are each independently hydrogen or a linear alkyl radical comprising from 1 to 4 carbon atoms, or $R_2$ forms, by bonding with $R_4$ or $R'_4$, a ring comprising from 5 to 6 carbon atoms.

4. The fuel composition of claim 3, wherein $R_2$, $R_3$, $R_4$ and $R'_4$ in the formula (II) are each a hydrogen atom.

5. The fuel composition of claim 3, wherein $R_1$, $R'_1$ and $R''_1$ are identical and are each an alkyl group of from 1 to 4 carbon atoms.

6. The fuel composition of claim 3, wherein the compounds of formula (II) are selected from the group consisting of trimethoxypropane, triethoxypropane, tripropoxypropane and tributoxypropane.

7. The fuel composition of claim 3, wherein $R_1$, $R'_1$ and $R''_1$ comprise from 1 to 4 carbons and at least one oxygen atom.

8. The fuel composition of claim 3, wherein the compounds of formula (II) are selected from the group consisting of tri(methoxyethoxy)propane and tri(ethoxyethoxy) propane.

9. The fuel composition of claim 3, wherein $R_1$ is an alkyl group comprising from 1 to 4 carbon atoms and $R'_1$ and $R''_1$ are connected and constitute a linkage comprising 2 to 3 carbons, to form, with the two oxygen atoms, a heterocycle comprising 5 to 6 atoms.

10. The fuel composition of claim 3, wherein the compound of formula (II) is 2-(2-hydroxyethyl)ethoxy-1,3-dioxolane.

11. The fuel composition of claim 3, wherein in the formula (II), $R_4$ is an alkyl group comprising from 1 to 4 carbon atoms, $R_2$, $R_3$ and $R'_4$ are hydrogen atoms and $R_1$, $R'_1$ and $R''_1$ are alkyl groups comprising from 1 to 5 carbon atoms.

12. The fuel composition of claim 3, wherein the compounds of formula (II) are selected from the group consisting of 1,1,3-trimethoxybutane, 1,1,3-triethoxybutane, 1,1,3-tripropoxybutane and 1,1,3-tributoxybutane.

13. The fuel composition of claim 3, wherein in the formula (II), $R_2$ or $R_3$ is each an alkyl group comprising 1 to 4 carbon atoms, $R_4$, $R'_4$ and $R_3$ or $R_2$ are hydrogen atoms and $R_1$, $R'_1$ and $R''_1$ are alkyl groups comprising from 1 to 5 carbon atoms.

14. The fuel composition of claim 3, wherein the compounds of formula (II) are selected from the group consisting of 1,1,3-triethoxy2-methylpropane and 1,3,3-triethoxybutane.

15. The fuel composition of claim 3, wherein the formula (II), $R_3$ and $R_4$ are hydrogen atoms, $R_2$ and $R'_4$ are connected in order to form a saturated ring comprising from 5 to 6 carbon atoms and $R_1$, $R'_1$ and $R''_1$ are alkyl groups comprising from 1 to 5 carbon atoms.

16. The fuel composition of claim 3, wherein the compound of formula (II) is 1,1,3-triethoxycyclohexane.

* * * * *